United States Patent [19]

Jasper

[11] 3,988,996

[45] Nov. 2, 1976

[54] CLEW CRINGLE

[76] Inventor: Aaron Jasper, P.O. Box 3527, St. Thomas, V.I.

[22] Filed: Sept. 15, 1975

[21] Appl. No.: 613,279

[52] U.S. Cl. ..... 114/115; 24/141
[51] Int. Cl.[2] ..... B63H 9/08
[58] Field of Search ..... 114/114, 115, 103; 24/141, 202

[56] References Cited

UNITED STATES PATENTS

| | | | |
|---|---|---|---|
| 2,393,984 | 2/1946 | Gookin | 24/141 |
| 2,550,788 | 5/1951 | Swart | 24/141 |
| 3,653,353 | 4/1972 | Davis | 114/115 |
| 3,903,826 | 9/1975 | Anderson | 114/103 |

FOREIGN PATENTS OR APPLICATIONS

| | | | |
|---|---|---|---|
| 188,002 | 9/1959 | Sweden | 24/141 |

*Primary Examiner*—Trygve M. Blix
*Assistant Examiner*—Stuart M. Goldstein

[57] ABSTRACT

The cringle or grommet disclosed is adapted for applying substantial loads to a fabric sail such, for instance, as a main sail or a genoa jib, and may be located at the clew of the sail to which point some rope or the like is attached for trimming the sail. The cringle employs a pair of complementary ring members, one on one side and the other on the other side of the fabric of the sail, each having a multiplicity of holes therethrough which are in registering relation and through which holes there is located rivets to clamp the rings together on the sail. The rings may be applied to the sail before an opening through the rings or through the sail is made after which an opening is made through the rings by a heated tool guided by the inner edge of the rings, which step melts the synthetic fabric of the sail so that the melted thickened periphery enters the chamfered inner edge of the rings, thus assisting in applying more resistance to a sail being pulled from between the rings.

2 Claims, 4 Drawing Figures

CLEW CRINGLE

BACKGROUND OF THE INVENTION

This invention relates to the placing of a grommet or cringle at the location in a sail to which some rope or the like is attached such, for instance, as the clew of the sail for applying and distributing rather large local loads to the fabric sail. In conventional sail-making procedures at locations where heavy loads were to be applied such, for instance, as the clew of the sail, a strengthening was provided largely by hand sewing a ring in several fabric layers but in a more recent procedure complementary metal rings have been applied on opposite sides of the fabric of the sail where a rope or the like was to be attached with teeth or pins extending from the inner surfaces of the rings into the fabric of the sail. A liner member has been passed through the center of the rings and rolled outwardly to bind the rings on the sail and also to provide a wearing surface. This necessitated a cutting of the hole in the sail of the attachment point prior to the application of the liner. The procedure was largely a hand operation and required tools of a special nature to perform the placing of the liner in position. Examples of this type of procedure are shown in U.S. Pat. Nos. 3,653,353 and 3,812,809.

The procedure outlined above was expensive and one of the objects of this invention is to provide a less expensive and yet sufficiently strong grommet or cringle and one which may be applied without special tools. Also to provide a relatively lightweight attachment or strengthening point and yet one which will be reliable in use. Other objects and features will be in part apparent as the more detailed description proceeds.

SUMMARY OF THE INVENTION

The present invention is adapted for applying and distributing a substantial or concentrated local load to a fabric sail. A pair of identical complementary ring members are provided, each of which has on one side a substantially flat surface and on the other side a toroidally rounded surface. Each member also includes a multiplicity of holes countersunk at the toroidal surface of the members with the holes in one member registering with holes in the other member. Rivets are passed through these holes and headed into the countersunk areas on the toroidal surfaces of the members. The inner surfaces of the ring members at the location of the contact with the fabric are chamfered and after the two rings are applied and riveted the sail is cut from the inner edges of the rings by a heated cutter which melts the inner peripheral edge of the synthetic fabric, such as Dacron or Nylon, into the chamfer in the inner edges of the ring, thus increasing the resistance of sail from being pulled from between the rings additional to the rivets which hold the rings clamped together.

DESCRIPTION OF THE PREFERRED EMBODIMENT

Figure 1:
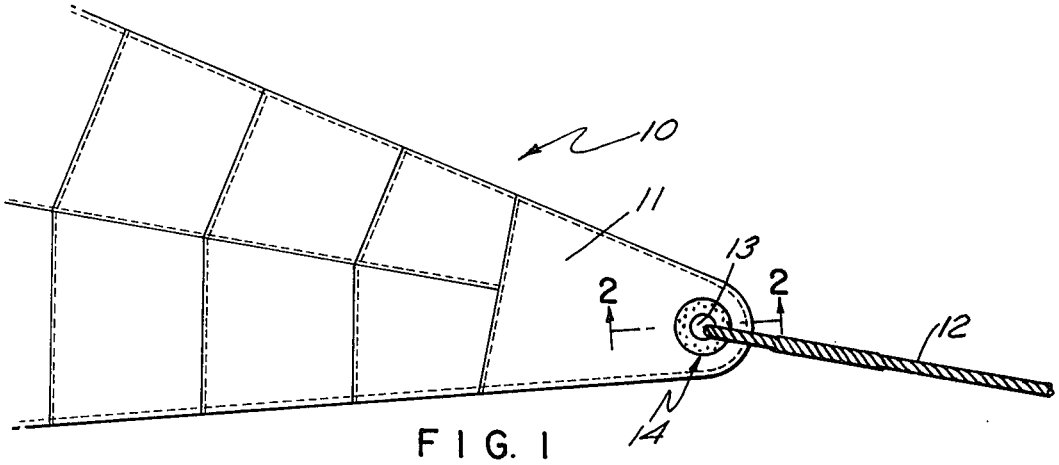
FIG. 1 is an elevation showing the clew of a sail with a sheet (rope) attached thereto.
Figure 2:
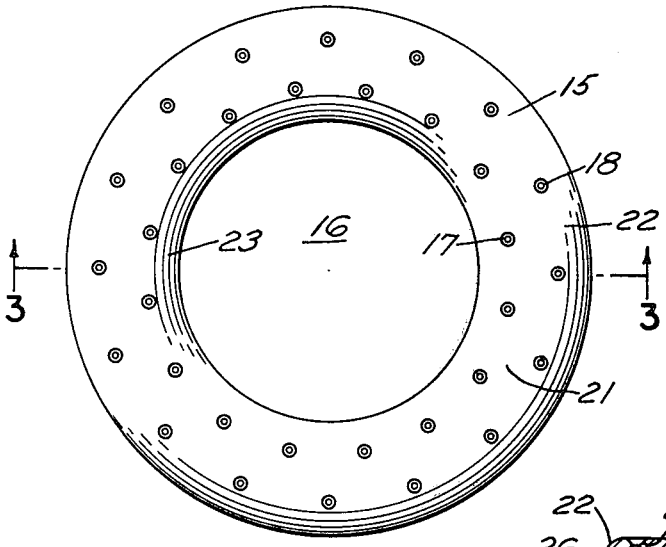
FIG. 2 is a plan view of one of the rings on a larger scale than shown in FIG. 1 which is applied to the clew of the sail.
Figure 3:
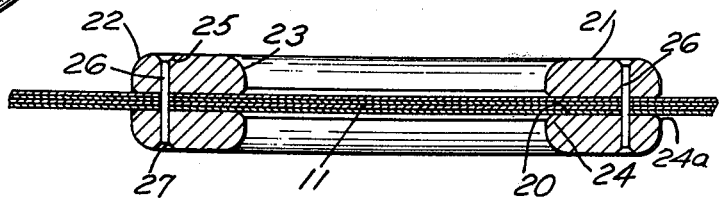
FIG. 3 is a sectional view showing two rings applied to the sail before the sail at the inner edges of the rings is severed.
Figure 4:
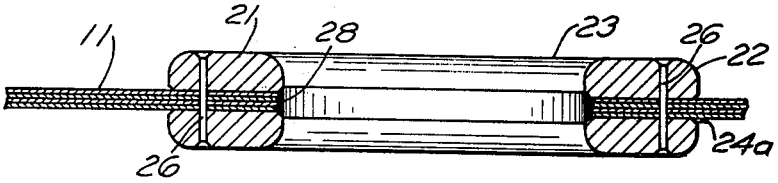
FIG. 4 is a view similar to FIG. 3 but showing the hole as cut in the sail.

Referring to FIG. 1, 10 designates the fragmental portion of the sail which in this instance is designated as the clew, the sails today being usually of synthetic material, such as Dacron or Nylon, which is strengthened by additional layers of material at the location of the clew 11. The rope or sheet 12 is applied to the clew of the sail by means of an opening 13 therein strengthened by a cringle or grommet 14 which is the subject of this invention.

This strengthening member 14 comprises a pair of rings 15 each having an opening 16 in its center and with holes 17 and 18 in concentric rows extending through the ring 15. The inner surface of these rings which contact the sail 11 are designated 20 and are flat, while the outer surface of the rings have gently curved edges with a flat surface 21 and a radius surface 22 on the outer side and radius surface 23 on the inner side. Also the inner edges of the rings as at 24 are slightly chamfered to provide a recess in the ring at the point of contacting the sail on its inner surface. The inner edges shown at 24a are also chamfered to a slight radius, about 1/16 inch, to avoid cutting the sail when the sail flexes. Each of the openings in the circles of openings 17 and 18 are countersunk or counterbored as at 25 and the rivets 26 which are passed through the registering openings in the two rings are headed over and enter these countersunk portions to provide heads 27 for the rivets and which are smooth at their ends conforming to the outer surface.

The two rings are applied to the opposite surfaces of the sail fabric prior to cutting the sail. Then with the inner edge of the rings as a guide the sail is cut by a heated cutting edge which in addition to cutting the sail melts the edge of the synthetic fabric forming a bead that enters the recesses 24 and is shown as at 28. Thus there is provided a rather rigid hard surface formed from the melting and subsequent hardening of the synthetic fibers of the fabric at the inner edge of the ring which will assist in preventing the sail from being pulled from beneath the two rings which are riveted about the cut opening.

This cringle or grommet may be formed in different sizes depending upon the strength desired and the size of the sail upon which they are to be utilized. It is intended that the rings will be formed of a marine aluminum alloy with the rivets of the same material. For illustration, the inner diameter of the rings may be 3 inches and the outer diameter 5 inches. The radius 22, 23 on the outer ring surfaces may be one-half inch. The countersunk for the rivets would be 3/32 of an inch and the rivets would be 3/32nds centered on 11/32nds from the nearest edge and each of the rings would be 5/16 thick. In another version the inside diameter may be 2 inches, the outside diameter 3½ inches, leaving each ring ¾ of an inch in width and a thickness of ¼ of an inch. In this case the rounded edges of the outer ring surface would be 5/16ths of an inch radius and the chamfer at the inner edge would be 1/16th radius. The rivets would be 1/16th of an inch in diameter and centered ¼ of an inch from the nearest edge. Other variations in sizes would be in the general proportion of that indicated above.

I claim:

1. In a fabric sail a grommet or clew cringle comprising a pair of rigid rings, one on either side of the sail fabric, the surfaces of the rings against the sail fabric being flat in a single plane throughout their extent, said rings each having inner and outer edges encircling an open center and having registering openings therein between said edges and rivets through said openings holding the rings in engagement with the fabric, the inner edges of the rings about said opening being radially arcuate to provide a smooth surface to a rope through said opening and the outer surface of the rings having the outer edges of each also of radially arcuate form, said rivets being countersunk into the outer surfaces of the two rings for a smooth surface thereover.

2. The combination of claim 1 wherein the inner edges of the flat surfaces have chamfered portions and the sail is of synthetic fiber with enlarged beaded edges lying in and filling the recess formed by said chamfered portions.

* * * * *